United States Patent [19]

Chau

[11] Patent Number: 4,808,071

[45] Date of Patent: Feb. 28, 1989

[54] CEILING FAN

[75] Inventor: Kwok Y. Chau, Ting Kau, Hong Kong

[73] Assignee: CEC Electrical Manufacturing (Int'l) Co. Ltd., Tuen Mun New Town, Hong Kong

[21] Appl. No.: 192,688

[22] Filed: May 11, 1988

[30] Foreign Application Priority Data

Jan. 29, 1988 [GB] United Kingdom ..... 8801974

[51] Int. Cl.[4] ..... F04D 25/08

[52] U.S. Cl. ..... 416/5; 416/170 R

[58] Field of Search ..... 416/5, 246, 170 R, 170 C

[56] References Cited

U.S. PATENT DOCUMENTS

| | | | |
|---|---|---|---|
| 4,073,598 | 2/1978 | Mizutani et al. | 416/5 |
| 4,357,506 | 11/1982 | Breining | 416/5 X |
| 4,402,649 | 9/1983 | Laurel | 416/5 |
| 4,428,032 | 1/1984 | Workman | 416/5 X |
| 4,621,977 | 11/1986 | Markwardt | 416/5 |
| 4,692,096 | 9/1987 | Yang | 416/170 C |
| 4,721,480 | 1/1988 | Yung | 416/5 X |

FOREIGN PATENT DOCUMENTS

| | | | |
|---|---|---|---|
| 101292 | 6/1983 | Japan | 416/170 C |
| 1208928 | 10/1970 | United Kingdom | 416/5 |
| 2149013 | 6/1985 | United Kingdom | 416/170 C |

*Primary Examiner*—Everette A. Powell, Jr.

*Attorney, Agent, or Firm*—Holman & Stern

[57] ABSTRACT

The ceiling fan has a motor and a removable switch unit. The motor comprises an inner stator, an outer rotor, a rotor casing rotatable with the rotor, and a tubular boss which depends from the stator and through which first wiring extends. The switch unit comprises a housing, switchgear for the motor contained in the housing, and second wiring connected to the switchgear. The first and second wiring have complementary electrical connectors which are able to pass through an aperture provided in the upper end of the housing and the housing has connecting means at its upper end for connecting the housing to the depending boss. The connecting means is in the form of an openable or enlargeable clamp to allow the connectors to be passed through the aperture and the first wiring to extend through and be withdrawn from the clamp.

8 Claims, 2 Drawing Sheets

CEILING FAN

INTRODUCTION

This invention relates to a ceiling fan. It is known to provide ceiling fans with a switch unit attached to the lower side of a fan motor.

It is, however, desirable for the switch unit to be readily detachable from the fan motor for servicing or for attaching a light fitting to the switch unit and the present invention seeks to provide a ceiling fan in a form which will permit this requirement to be met.

SUMMARY OF THE INVENTION

According to the present invention there is provided a ceiling fan having a motor and a switch unit, the motor comprising an inner stator, an outer rotor, a rotor casing rotatable with the rotor, and a tubular boss which depends from the inner stator and through which first wiring means extends, and the switch unit comprising a housing, switchgear for the motor contained within the housing, and second wiring means connected to the switchgear, wherein the first and second wiring means have complementary electrical connectors which are able to pass through an aperture provided in the upper end of the housing and wherein the housing has connecting means at its upper end for connecting the housing to the depending boss, the connecting means comprising an openable on enlargeable clamp to allow the complementary connectors to be passed through said aperture and the first wiring means to extend through and be withdrawn from said clamp.

Preferred and/or optional features of the invention ae set forth in claims 2 to 8, inclusive.

The invention will now be more particularly described, by way of example only, with reference to the accompanying drawings.

DESCRIPTION OF PREFERRED EMBODIMENT

Figure 1:
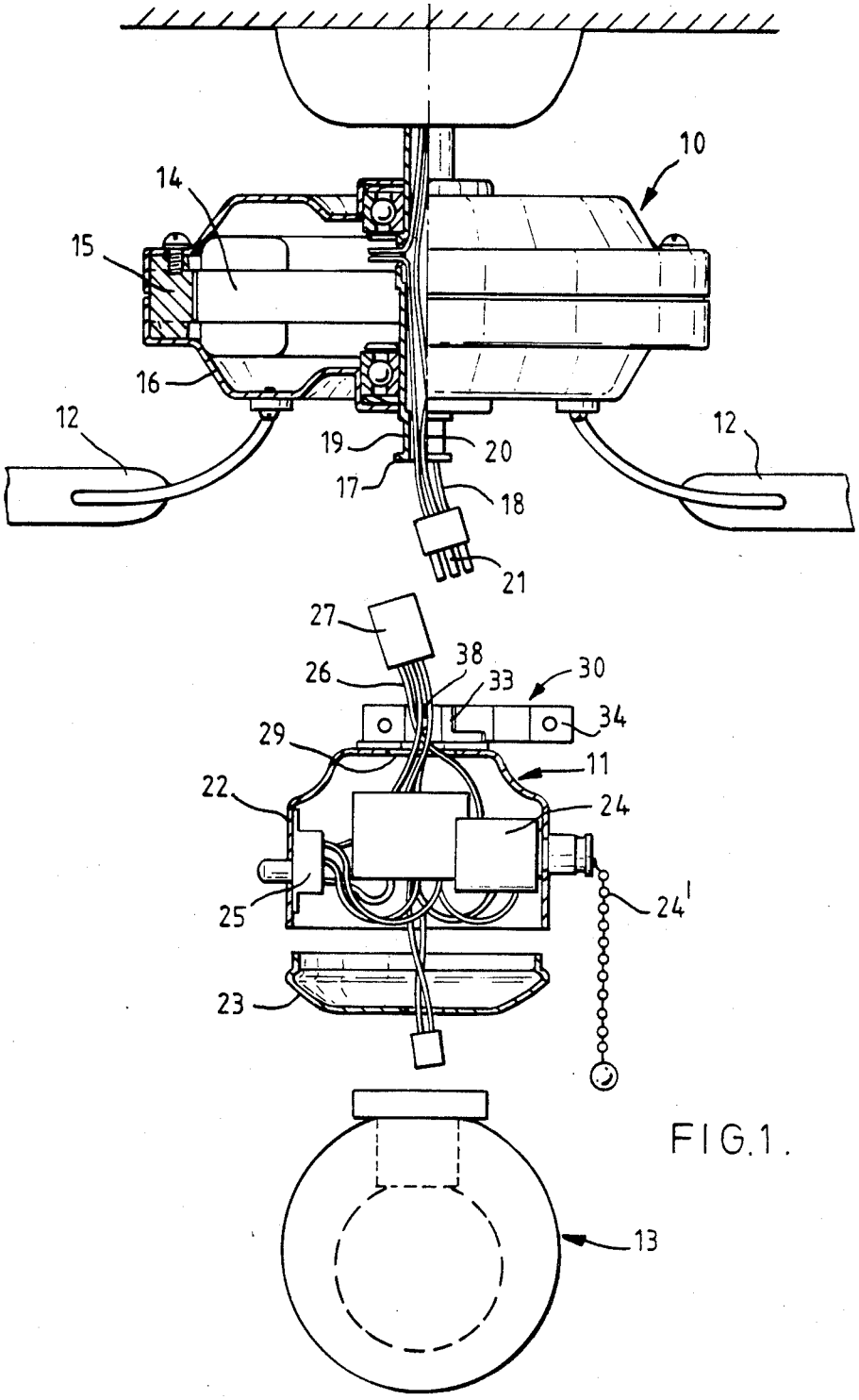
FIG. 1 is an exploded side view of one embodiment of a ceiling fan according to the invention, with parts broken away for clarity.

Referring to the drawings, the ceiling fan showing therein comprises a fan motor 10, a switch unit 11, fan blades 12, and a light fitting 13.

The fan motor 10 comprises an inner stator 14, an outer rotor 15, and a rotor casing 16 rotatable with the rotor 15, as is well known in the art. The fan blades 12 are secured to the rotor casing 16 for rotation therewith.

A tubular boss 17 depends from the stator 14 and first electrical wiring 18 connected to the motor and for connection to a power supply (not shown) extends through the boss 17. The boss 17 has a circumferential groove 19 and a hole 20 in the base of the groove for a purpose which will become apparent hereinafter. An electrical connector in the form of a multi-terminal plug 21 is connected to the wiring 18.

The switch unit 11 has upper and lower housing parts 22 and 23 respectively. Switchgear comprising a rotary on/off switch 24 operable by a pull chord 24' and a change-over switch 25 for reversing the direction of the motor is provided in the housing and fixed to the upper housing part 22. Wiring 26 connects the switchgear to a further electrical connector in the form of a multi-terminal socket 27. The upper and lower housing parts 22 and 23 are secured together by screws.

The light fitting 13 can be attached to the lower housing part 23.

Figure 2:
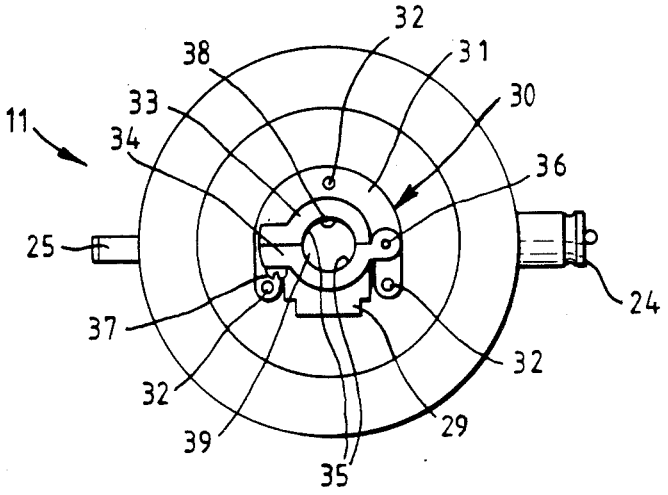
FIG. 2 is a plan view of the switch unit showing the clamp in a closed position.
Figure 3:
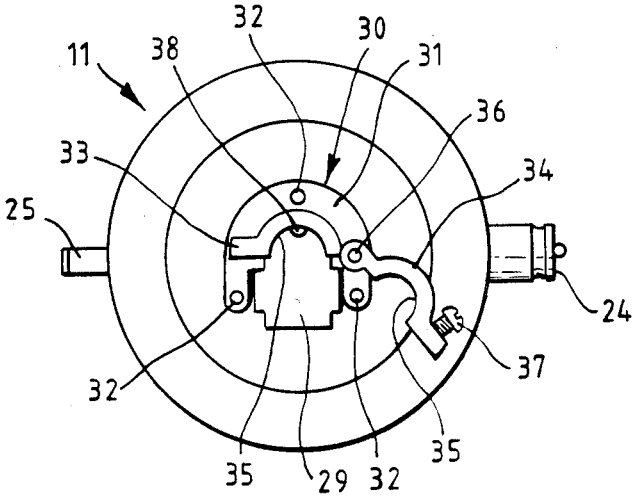
FIG. 3 is a view similar to FIG. 2 but showing the clamp in an open position.

An aperture 29 (see FIGS. 2 and 3) is provided in the upper end of the upper housing part 22 and this aperture 29 is shaped and dimensioned so as to allow the plug 21 and the socket 27 to pass therethrough.

Connecting means in the form of an openable clamp 30 is provided on the upper end of the upper housing part 22, the clamp 30 comprising a base 31 secured to the upper housing part 22 by screws 32 and clamping members 33 and 34 each having a semi-cylindrical clamping face 35. The clamping member 33 is formed integrally with the base 31 and hence is fixed relative to the upper housing part 22. The clamping member 34 is connected to the clamping member 33 by a hinge 36 so as to be moveable between open and closed positions relative to the clamping member 33 and the clamping member 34 has a threaded fastening member 37 engageable with a threaded hole in the clamping member 33 for releasably fastening the clamping member 34 in a closed position relative to the clamping member 33.

A protrusion 38 in the form of a head of a screw projects radially inwards from the clamping face 35 of the clamping member 33 and the bore 39 defined by the clamping members 33 and 34, as considered in a closed position relative to one another, is aligned, as viewed in plan, with a part of the aperture 29.

In order to connect the switch unit 11 to the fan motor 10, the socket 27 is firstly withdrawn from the switch unit housing through the aperture 29 and this is most easily done with the upper and lower housing parts 22 and 23, respectively, separated as access can be gained to the interior of the upper housing part 22 to feed the socket 27 through the aperture 29.

The plug 21 is then connected to the socket 27 with the clamp 30 in an open position and the plug and socket are fed back into the housing. Finally the clamp 30 can be connected to the tubular boss 17 with the wiring 18 extending through the clamp 30. To do this, the clamping face 35 of the clamping member 33 is placed in contact with the base of the groove 19 in the boss 17 with the protrusion 38 located in the hole 20. The clamping member 34 is then swivelled into a closed position relative to the clamping member 33 and fastened thereto by fastening member 37. The walls of the groove 19 locate the clamp 30 axially with respect to the boss 17 and the interengagement between the protrusion 38 and the hole 20 locate the clamp 30 angulaly with respect to the boss 17.

With the above described arrangement the switch unit 11 can be readily removed from the fan motor 10 for servicing or in order to connect the light fitting 13 to or remove the light fitting 13 from the switch unit 11.

Instead of being hingably connected to the clamping member 33, the clamping member 34 could be entirely separable from and securable to the clamping member 33. Alternatively, the clamp 20 could be expandible rather than openable in which case it could be in a form somewhat similar to a Jubilee clip.

Various other modifications will be apparent to persons skilled in the at without departing from the scope of the invention defined by the appendant claims.

What I claim is:

1. A ceiling fan having a motor and a switch unit, the motor comprising an inner stator, an outer rotor, a rotor casing rotatable with the rotor, a tubular boss which depends from the inner stator and first wiring means extending through said boss, and the switch unit comprising a housing, switchgear for the motor contained within the housing, and second wiring means connected to the switchgear, wherein the first and second wiring means have complementary electrical connectors which are able to pass through an aperture provided in the upper end of the housing and wherein the housing has connecting means at its upper end for connecting the housing to the depending boss, the connecting means comprising an openable or enlargeable clamp to allow the complementary connectors to be passed through said aperture and the first wiring means to extend through and be withdrawn from said clamp.

2. A ceiling fan as claimed in claim 1, wherein the depending boss has a circumferential groove for receiving said clamp.

3. A ceiling fan as claimed in claim 1, wherein the clamp comprises two parts, a hinge connecting the two parts together for movement between closed and open positions, and means for releasably fastening the two parts in said closed position.

4. A ceiling fan as claimed in claim 3, wherein one of the parts is fixed relative to the housing.

5. A ceiling fan as claimed in claim 1, wherein the housing comprises upper and lower housing parts releasably fastened together, the switchgear being fixed to the upper housing part.

6. A ceiling fan as claimed in claim 1, wherein the switchgear comprises a rotary switch.

7. A ceiling fan as claimed in claim 1, wherein fan blades are connected to the rotor casing.

8. A ceiling fan as claimed in claim 1, wherein a light fitting is attached to a lower end of the switch unit housing.

* * * * *